US009751538B2

(12) United States Patent
Takahashi et al.

(10) Patent No.: US 9,751,538 B2
(45) Date of Patent: Sep. 5, 2017

(54) SOUND ABSORBING PANEL

(71) Applicants: CENTRAL JAPAN RAILWAY COMPANY, Nagoya-shi, Aichi (JP); NIPPON SHARYO, LTD., Nagoya-shi, Aichi (JP)

(72) Inventors: Yukio Takahashi, Toyohashi (JP); Hiroki Tsunoda, Atami (JP); Yuya Futamura, Nagoya (JP); Koichi Hayashi, Tsuru (JP); Naoya Ozawa, Toyokawa (JP); Masaki Hase, Inazawa (JP); Naoyuki Maruyama, Hachioji (JP)

(73) Assignees: CENTRAL JAPAN RAILWAY COMPANY, Nagoya (JP); NIPPON SHARYO, LTD., Nagoya (JP)

( * ) Notice: Subject to any disclaimer, the term of this patent is extended or adjusted under 35 U.S.C. 154(b) by 177 days.

(21) Appl. No.: 14/646,200

(22) PCT Filed: Oct. 31, 2013

(86) PCT No.: PCT/JP2013/079603
§ 371 (c)(1),
(2) Date: May 20, 2015

(87) PCT Pub. No.: WO2014/080734
PCT Pub. Date: May 30, 2014

(65) Prior Publication Data

US 2015/0314794 A1 Nov. 5, 2015

(30) Foreign Application Priority Data

Nov. 21, 2012 (JP) ..... 2012-255650

(51) Int. Cl.
*B61D 17/18* (2006.01)
*B61D 17/00* (2006.01)
(Continued)

(52) U.S. Cl.
CPC ..... *B61D 17/00* (2013.01); *B61D 17/18* (2013.01); *B61D 25/00* (2013.01); *B61D 37/003* (2013.01); *G10K 11/168* (2013.01)

(58) Field of Classification Search
CPC ..... B61D 17/00; B61D 17/005; B61D 17/04; B61D 17/041; B61D 17/08; B61D 17/18; B61D 17/185; B61D 17/20
See application file for complete search history.

(56) References Cited

U.S. PATENT DOCUMENTS 3,046,179 A 7/1962 Stallard
3,672,309 A * 6/1972 Van Der Sluys ..... B61D 17/02 105/401
(Continued)

FOREIGN PATENT DOCUMENTS

CN 1817691 A 8/2006
DE 2946892 A1 6/1981
(Continued)

OTHER PUBLICATIONS

Jul. 7, 2016 Search Report issued in European Patent Application No. 13857214.4.
(Continued)

*Primary Examiner* — R. J. McCarry, Jr.
(74) *Attorney, Agent, or Firm* — Oliff OLC

(57) ABSTRACT

Provided is a sound absorbing panel that can satisfy the heat resistance properties and melting/dripping resistance properties required inside of a railway vehicle. A pier sound absorbing panel includes five sheets of first through fifth glass cloths that are stacked on an aluminum base plate. The edge section of the fifth glass cloth is affixed to the rear surface of the base plate using an adhesive, and the first through fourth glass cloths are fastened using staples. In other words, the first glass cloth and the base plate are fixed using an adhesive, and this adhesive is prevented from
(Continued)

melting by the five sheets of the first through fifth glass cloths. The adhesive that fixes the edge section of the fifth glass cloth at the other surface of the base plate is prevented from melting by the five sheets of the first through fifth glass cloths and the base plate.

12 Claims, 11 Drawing Sheets

(51) Int. Cl.

| | |
|---|---|
| ***B61D 25/00*** | (2006.01) |
| ***B61D 37/00*** | (2006.01) |
| ***G10K 11/168*** | (2006.01) |

(56) References Cited

U.S. PATENT DOCUMENTS

| | | | | |
|---|---|---|---|---|
| 5,644,989 | A * | 7/1997 | Blanchier ..... | B61D 1/06 105/340 |
| 7,249,654 | B2 | 7/2007 | Nakamoto et al. | |

FOREIGN PATENT DOCUMENTS

| | | | |
|---|---|---|---|
| EP | 1690770 | A1 | 8/2006 |
| JP | S60-157454 | U | 10/1985 |
| JP | H02-124137 | U | 10/1990 |
| JP | H04-22745 | B2 | 4/1992 |
| JP | H08-142246 | A | 6/1996 |
| JP | H09-111911 | A | 4/1997 |
| JP | 2001-271438 | A | 10/2001 |
| JP | 2006-119228 | A | 5/2006 |
| JP | 2009-132294 | A | 6/2009 |
| JP | 2010-100278 | A | 5/2010 |
| WO | 2009/081760 | A1 | 7/2009 |

OTHER PUBLICATIONS

Feb. 4, 2014 Search Report issued in International Application No. PCT/JP2013/079603.

* cited by examiner

SOUND ABSORBING PANEL

TECHNICAL FIELD

The present invention relates to a sound absorbing panel, particularly, to a sound absorbing panel that satisfies a heat resistance and a melt-dripping resistance required for the inside of a railway vehicle.

BACKGROUND ART

Conventionally, various sound absorbing panels are proposed. For example, the following Patent Literature 1 discloses a stacked body excellent in sound absorbency and fireproof performance by stacking a glass cloth on one surface of a punching metal.

The following Patent Literature 2 discloses the technology that absorbs sound noise inside the cabin by employing glass wool, sponge, and foamed resin stacked between two punching metals as a cover of the baggage rack in a railway vehicle.

CITATION LIST

Patent Literature

Patent Literature 1: Japanese Unexamined Patent Application Publication No. 9-111911

Patent Literature 2: Japanese Unexamined Patent Application Publication No. 2010-100278

SUMMARY OF INVENTION

Technical Problem

However, in the case where the above-described stacked body described in Patent Literature 1 is used for the inner wall surface of a railway vehicle, one layer of glass cloth is used and there is no description of what attaches the punching metal and the glass cloth to each other. Accordingly, there is the possibility that the heat resistance and the melt-dripping resistance required for the inside of the railway vehicle cannot be satisfied. For example, attachment of the punching metal and the glass cloth with an adhesive is likely not to satisfy the heat resistance and the melt-dripping resistance.

On the other hand, the technology described in Patent Literature 2 is the technology related to a cover of the baggage rack, and is not applicable to the inner wall surface of the railway vehicle. If this technology is applied while one punching metal of the two punching metals is removed, there is no description of what attaches and stacks the glass wool, the sponge and the foamed resin together. Accordingly, similarly to the above description, there is a high possibility that the heat resistance and the melt-dripping resistance required for the inside of the railway vehicle cannot be satisfied.

The present invention has been made to address the above-described problems, and it is an object of the present invention to provide a sound absorbing panel that satisfies a heat resistance and a melt-dripping resistance required for the inside of a railway vehicle.

Solution to Problem and Advantageous Effects of Invention

The sound absorbing panel according to claim 1 provides the following effect. That is, on one surface of the metallic base plate, at least one or more glass cloths, which constitute the inner layer, and the glass cloth, which constitutes the coating layer, are stacked. That is, on one surface of the base plate, at least two or more glass cloths are stacked. Moreover, the glass cloth constituting the coating layer has the edge portion secured to the other surface of the base plate. Accordingly, these two or more glass cloths provide the effect that satisfies the heat resistance and the melt-dripping resistance required for the inside of the railway vehicle.

The sound absorbing panel according to claim 2 provides the following effect in addition to the effect provided by the sound absorbing panel according to claim 1. That is, to the other surface of the base plate, the hook-and-loop fastener is secured. This facilitates removably installing the sound absorbing panel on the inner wall surface of the railway vehicle. To the other surface of the base plate, the reinforcing plate is secured. This reduces occurrence of a wave in the sound absorbing panel when the hook-and-loop fastener is secured to the other surface of the base plate, thus allowing installing the sound absorbing panel in a flat condition. Further, the through-hole is opened at the base plate. This forms an air layer between the inner wall surface of the railway vehicle and the other surface of the base plate. Accordingly, the sound noise inside the cabin transmits to the air layer via the through-hole and the air layer vibrates, so as to absorb the sound noise. This provides the effect that improves the sound absorbing property of the glass cloth.

The sound absorbing panel according to claim 3 provides the following effect in addition to the effect provided by the sound absorbing panel according to claim 1 or 2. That is, the base plate and the inner layer are secured to each other with the adhesive. Alternatively, the base plate and the edge portion of the coating layer are secured to each other with the adhesive. This provides the effect that facilitates securing both the members.

The sound absorbing panel according to claim 4 provides the following effect in addition to the effect provided by the sound absorbing panel according to any one of claims 1 to 3. That is, the coating layer has the portion covering the side portions of the base plate and the inner layer. The covering portion inclines to form an acute angle with the base plate. This ensures a thinner thickness of the outer peripheral portion of the sound absorbing panel. Accordingly, this provides the effect that, for example, easily sandwiches the outer peripheral portion between the inner wall surface of the railway vehicle and the window frame or between the inferior surface of the baggage rack and the front bar.

The sound absorbing panel according to claim 5 provides the following effect in addition to the effect provided by the sound absorbing panel according to any one of claims 1 to 4. That is, to the other surface of the base plate, the supporting member is secured. The supporting member projects to the opposite side to the inner layer at the inner side of the outer peripheral portion of the base plate. Accordingly, this provides the effect that, for example, the supporting member intervenes between the other surface of the base plate and the inner wall surface even when the inner wall surface of the railway vehicle is formed in an arc shape, so as to allow the supporting member to inhibit the sound absorbing panel from being depressed toward the inner wall surface side.

The sound absorbing panel according to claim 6 provides the following effect in addition to the effect provided by the sound absorbing panel according to any one of claims 1 to 5. That is, to the other surface of the base plate, a coupling member is secured. The coupling member laterally projects with respect to the outer peripheral portion to be coupled to the other sound absorbing panel. Coupling the coupling members of a plurality of sound absorbing panels to one another before installation on the inner wall surface of the railway vehicle facilitates installation work of the sound absorbing panels. In particular, in the case where the inner wall surface of the railway vehicle is formed in an arc shape, this configuration is effective.

The sound absorbing panel according to claim 7 provides the following effect in addition to the effect provided by the sound absorbing panel according to any one of claims 1 to 6. That is, the staple includes the center portion and the bent portion, which is bent from both end portions of the center portion. The staples include: the first-direction row group where the longitudinal directions of the center portions of the staples are oriented to the first direction, a plurality of rows where the staples are arranged at predetermined intervals along the first direction are formed in the second direction intersecting with the first direction, and the center portions adjacent to one another in the second direction are formed in a staggered arrangement; and the second-direction row group where the staples are formed between the predetermined intervals, the longitudinal directions of the center portions of the staples are oriented to the second direction, a plurality of rows where the staples are arranged at the predetermined intervals along the second direction are formed in the first direction, and the center portions adjacent to one another in the first direction are formed in a staggered arrangement. This provides the effect that reduces occurrence a wave in the sound absorbing panel so as to ensure a flat surface.

The railway vehicle according to claim 8 provides the following effect. The sound absorbing panel according to any one of claims 1 to 7 is installed on at least one or more of: the inner wall surface between the windows adjacent to each other; the inner wall surface between the window and the baggage rack; the inferior surface of the baggage rack; the top surface of the baggage rack; the inner wall surface located at an upper side of the baggage rack; and the ceiling surface of the gangway. This provides the effect that satisfies the heat resistance and the melt-dripping resistance required for the railway vehicle.

The railway vehicle according to claim 9 provides the following effect in addition to the effect provided by the railway vehicle according to claim 8. The end portion of the sound absorbing panel is sandwiched between the window trim and the inner wall surface. This provides the effect that inhibits the sound absorbing panel from being dropped off.

The railway vehicle according to claim 10 provides the following effect in addition to the effect provided by the railway vehicle according to claim 8 or 9. The sound absorbing panel to be installed on the inferior surface of the baggage rack is sandwiched between the inferior surface of the baggage rack and the front bar. This provides the effect that inhibits the sound absorbing panel from being dropped off.

The railway vehicle according to claim 11 provides the following effect in addition to the effect provided by the railway vehicle according to any one of claims 8 to 9. That is, on the hole opened at the base plate of the sound absorbing panel, the hook projecting from the inner wall surface to the cabin side is hooked. This provides the effect that inhibits the sound absorbing panel from being dropped off.

The railway vehicle according to claim 12 provides the following effect in addition to the effect provided by the railway vehicle according to any one of claims 8 to 11. That is, on the inner wall surface of the railway vehicle, the first base and the second base project. The plate-shaped presser plate is bridged across the projecting end portion of the first base and the projecting end portion of the second base while having the predetermined width. The sound absorbing panel is sandwiched between the inner wall surface and the presser plate. This provides the effect that inhibits the sound absorbing panel from being dropped off.

DESCRIPTION OF EMBODIMENTS

Figure 1:
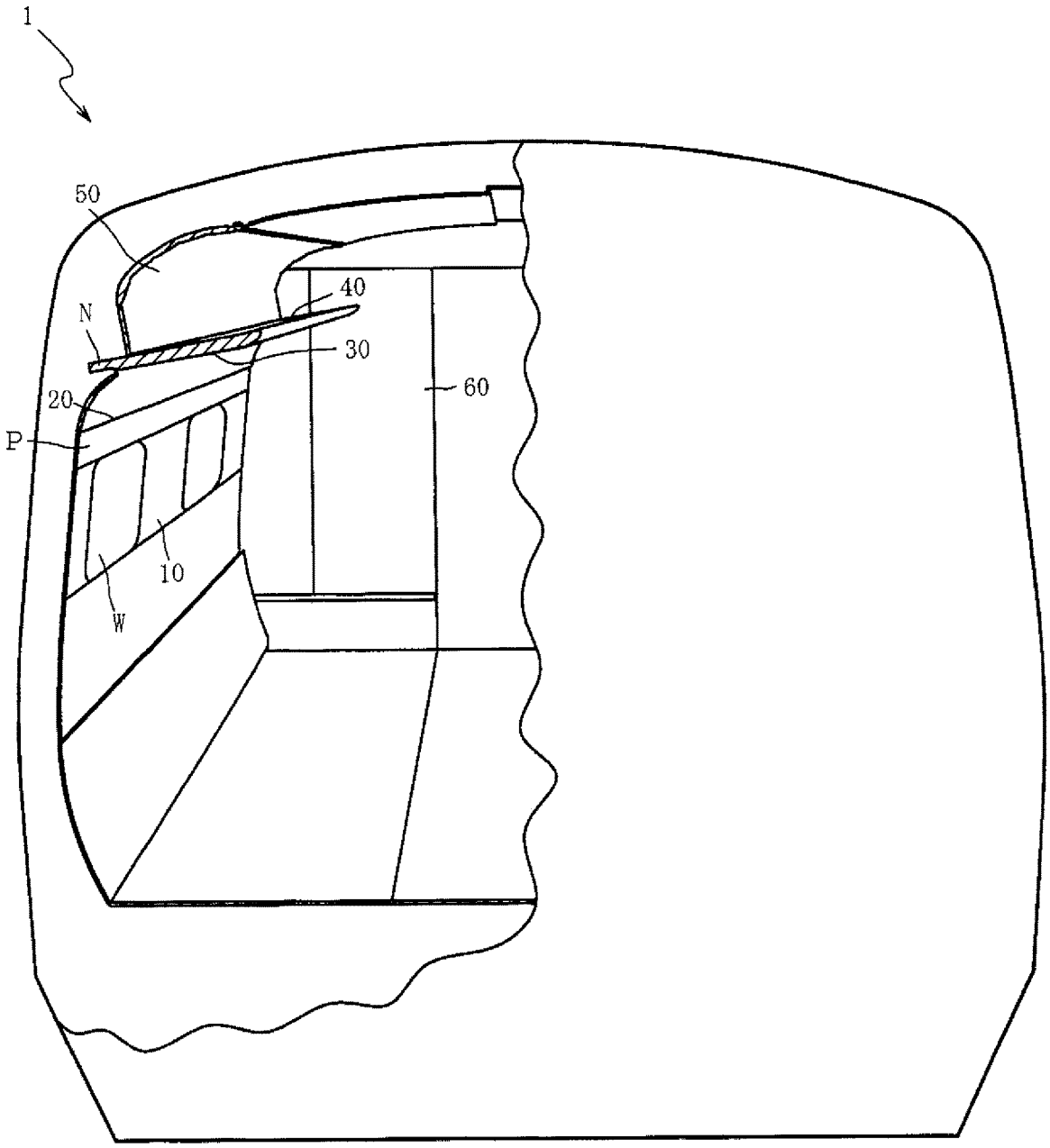
FIG. 1 is a schematic diagram illustrating the inside of a cabin of a railway vehicle.

Preferred embodiments according to the present invention will be described below by referring to the accompanying drawings. Firstly, a description will be given of the position where a sound absorbing panel is installed in a railway vehicle 1. FIG. 1 is a schematic diagram illustrating the inside of the cabin of the railway vehicle 1. Here, in FIG. 1, illustrations of seats and similar members are omitted.

The cabin of the railway vehicle 1 mainly includes a plurality of windows W, space P, and a baggage rack N. The windows W are disposed on the inner wall surface inside the cabin at predetermined intervals from one another along the longitudinal direction. The space P is the inner wall surface at the upper side of the window W, and in this space P, seat number plates (not illustrated), clothes hangers (not illustrated), and similar members are arranged. The baggage rack N projects to the inside of the cabin from the inner wall surface at the upper side of the space P.

The sound absorbing panel according to the present invention includes a pier sound absorbing panel 10, an upper-side-wall sound absorbing panel 20, a baggage-rack lower sound absorbing panel 30, a baggage-rack upper sound absorbing panel 40, a side-ceiling sound absorbing panel 50, and an end-portion sound absorbing panel 60.

The pier sound absorbing panel 10 is installed on the inner wall surface between two adjacent windows W. The upper-side-wall sound absorbing panel 20 is installed on the inner wall surface in an arc shape extending from the space P to the lower side of the baggage rack N. The baggage-rack lower sound absorbing panel 30 is installed over the entire surface of the inferior surface of the baggage rack N. The baggage-rack upper sound absorbing panel 40 is installed over the entire surface of the top surface of the baggage rack N. The side-ceiling sound absorbing panel 50 is installed on the inner wall surface in an arc shape extending from the upper side of the baggage rack N toward the ceiling. The end-portion sound absorbing panel 60 is installed on the inner wall surfaces at the front and back sides of each vehicle.

Here, while illustration is omitted in FIG. 1, also at the right side of the railway vehicle 1 illustrated in FIG. 1, the sound absorbing panels identical to those at the left side are installed. In the railway vehicle 1, a gangway, which couples the front and rear vehicles together, is formed. Also on the ceiling surface of the gangway, a sound absorbing panel is installed.

Figure 2A:
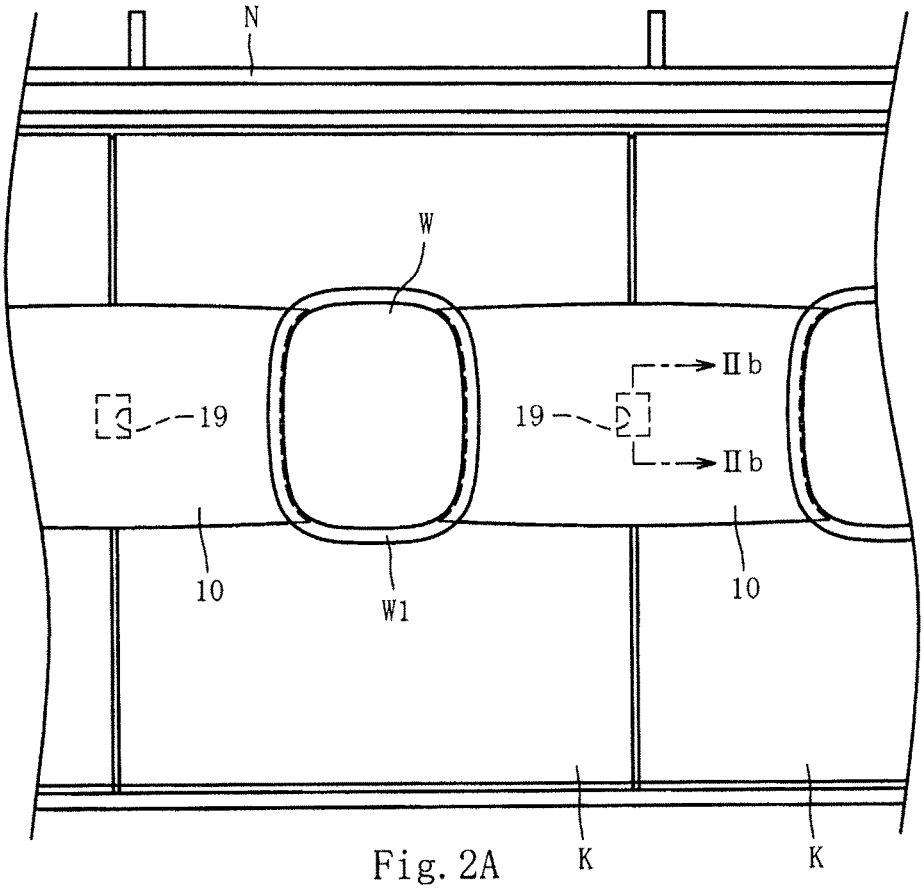
FIG. 2(*a*) is a front view of the vicinity of a window viewed from the cabin side, and FIG. 2(*b*) is a cross-sectional view taken along the cross-sectional line IIb-IIb illustrated in FIG. 2(*a*).
Figure 2B:
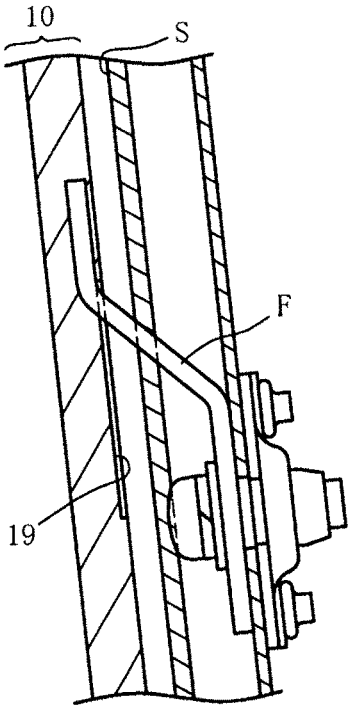

The following describes the pier sound absorbing panel 10 with reference to FIG. 2 to FIG. 5. Firstly, a description will be given of an installation form of the pier sound absorbing panel 10 with reference to FIG. 2. FIG. 2(*a*) is a front view of the vicinity of a window viewed from the cabin side. FIG. 2(*b*) is a cross-sectional view taken along the cross-sectional line IIb-IIb illustrated in FIG. 2(*a*).

The pier sound absorbing panel 10 is formed in a plate shape (see FIG. 2(*b*)), and is installed on the inner wall surface between the adjacent windows W. As described later, a hook-and-loop fastener is secured to the backside surface of the pier sound absorbing panel 10. The pier sound absorbing panel 10 is removably installed on the inner wall surface via the hook-and-loop fastener. This facilitates the exchanging work of the pier sound absorbing panel 10.

In the peripheral area of the window W, a window frame W1 is installed at a predetermined interval from the inner wall surface of the railway vehicle 1. Both right and left end portions of the pier sound absorbing panel 10 are sandwiched between the window frame W1 and the inner wall surface. At the lower side of the window W, a spandrel wall K is disposed. The lower end portion of the pier sound absorbing panel 10 is supported on the upper end of the spandrel wall K. Further, as illustrated in FIG. 2(*b*), on the backside surface of the pier sound absorbing panel 10, a hole 19 is opened. An S-shaped hook F projects from the inner wall surface S of the railway vehicle 1. The hole 19 of the pier sound absorbing panel 10 is hooked on the hook F. As just described, the pier sound absorbing panel 10 is installed not to easily drop off from the inner wall surface while being removably installed on the inner wall surface of the railway vehicle 1 by the hook-and-loop fastener.

Figure 3A:
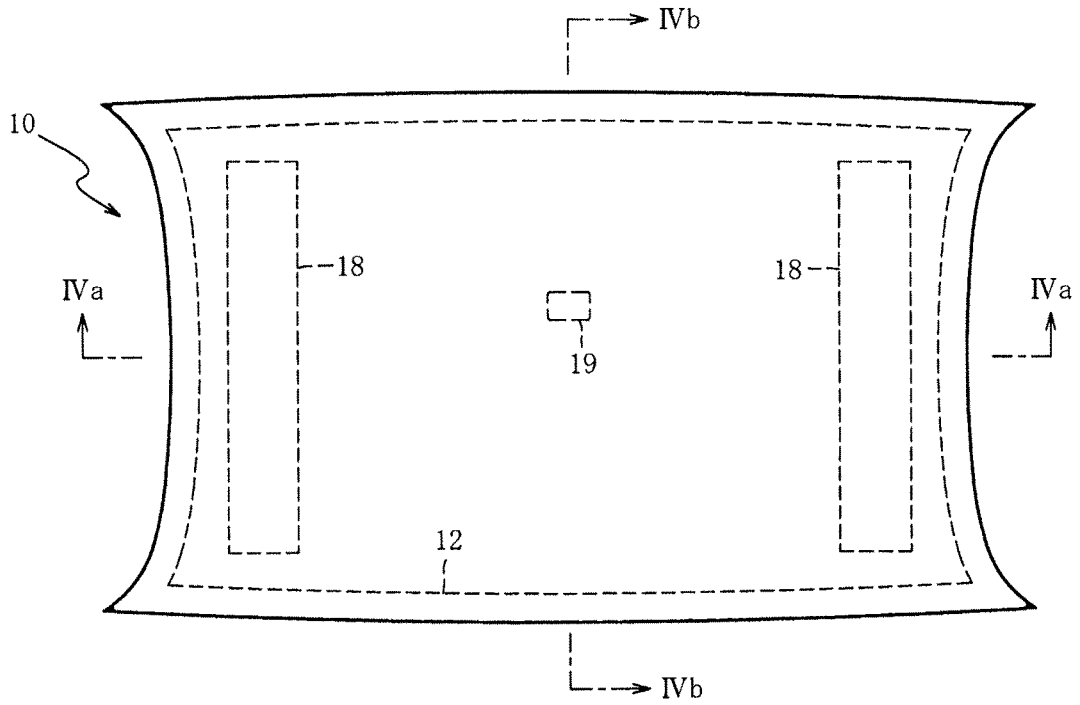
FIG. 3(*a*) is a front view of a pier sound absorbing panel, and FIG. 3(*b*) is a back view of the pier sound absorbing panel.
Figure 3B:
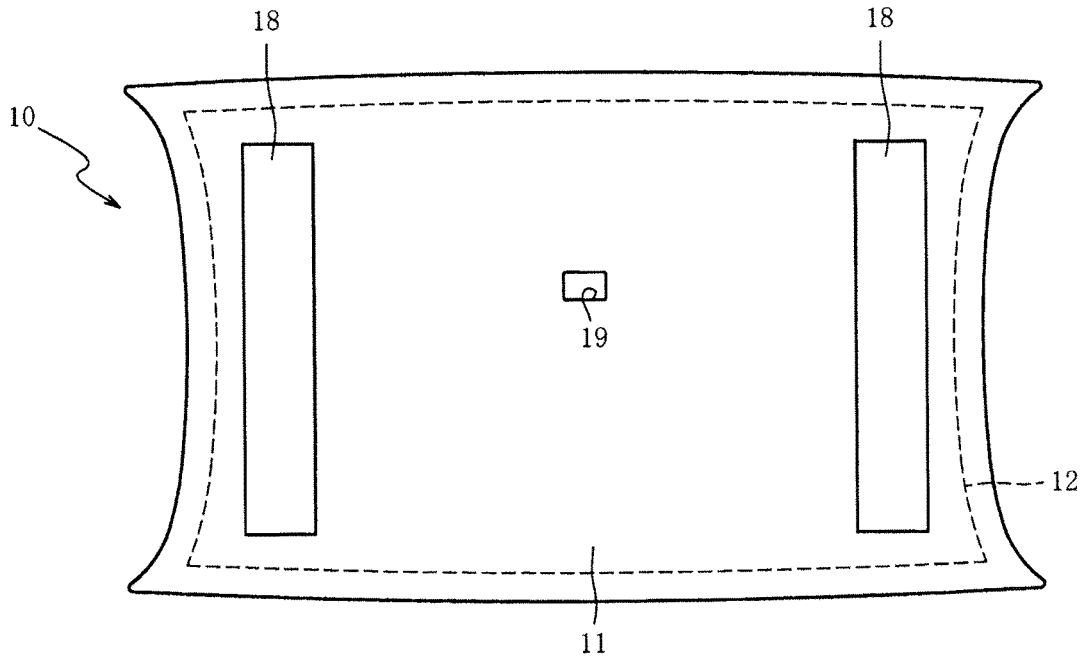
Figures 4A, 4B:
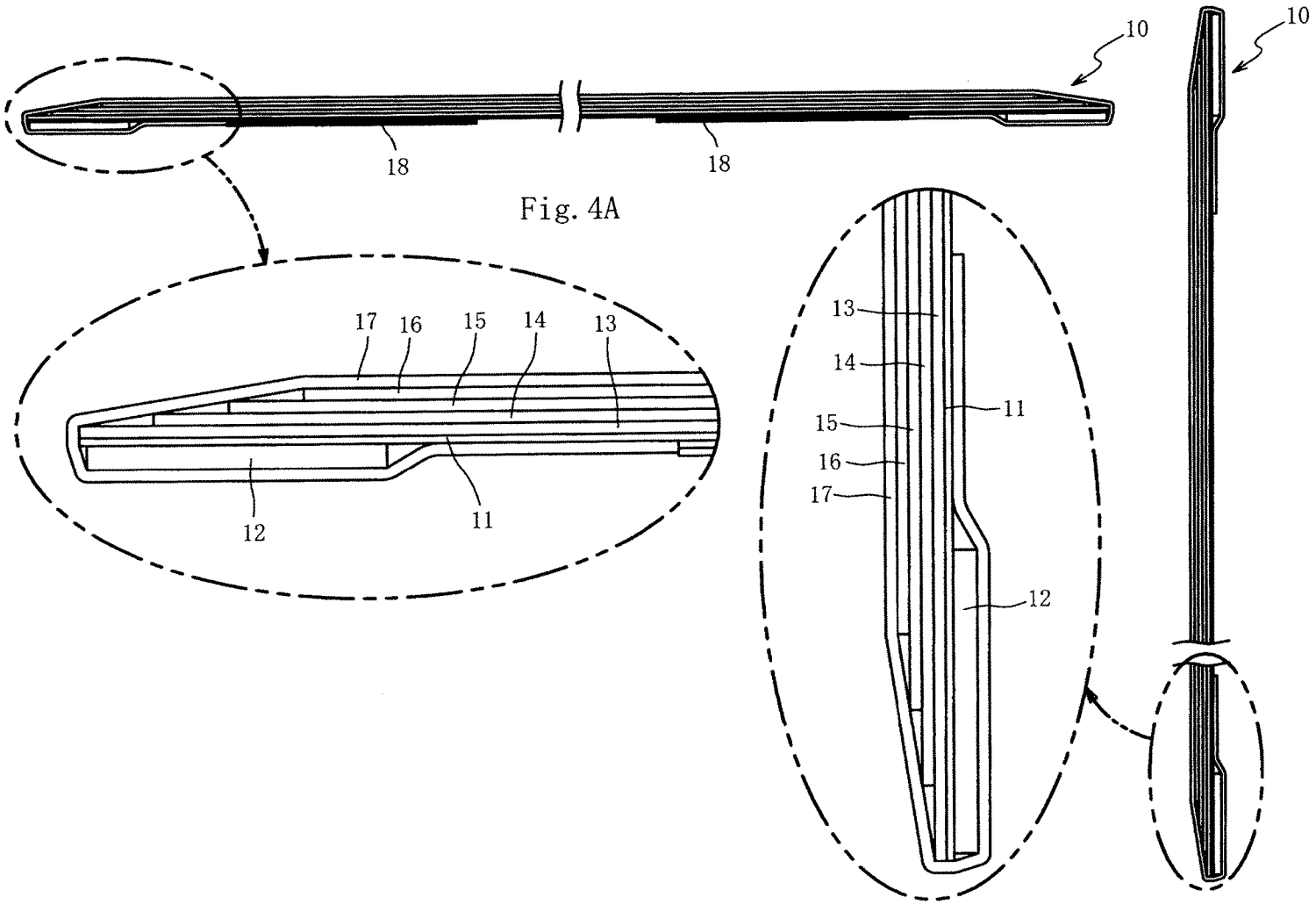
FIG. 4(*a*) is a cross-sectional view taken along the cross-sectional line IVa-IVa illustrated in FIG. 3(*a*), and FIG. 4(*b*) is a cross-sectional view taken along the cross-sectional line IVb-IVb illustrated in FIG. 3(*a*).
Figure 5A:
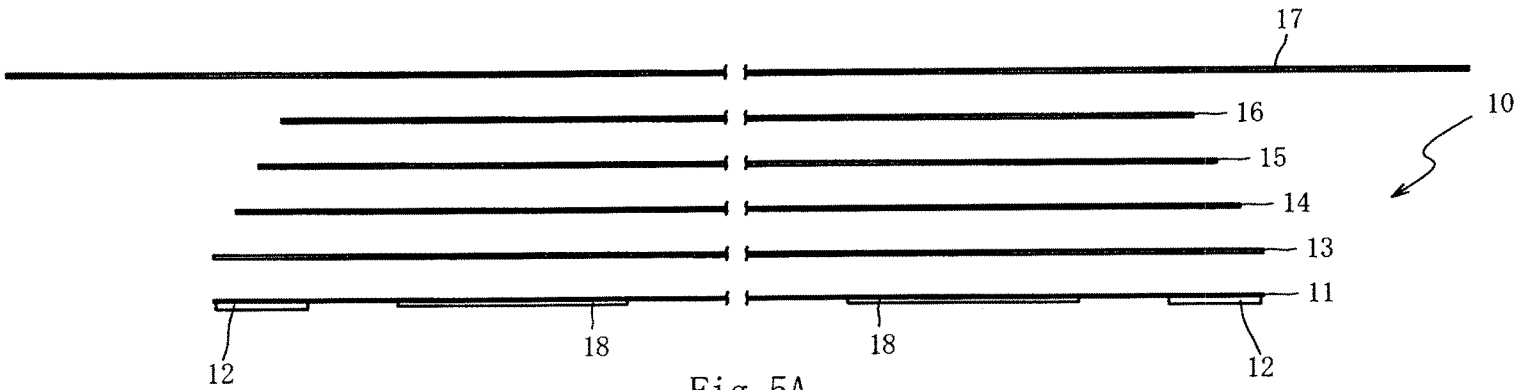
FIG. 5(*a*) is an exploded view of the pier sound absorbing panel, and FIG. 5(*b*) is a front view of an inner layer.
Figure 5B:
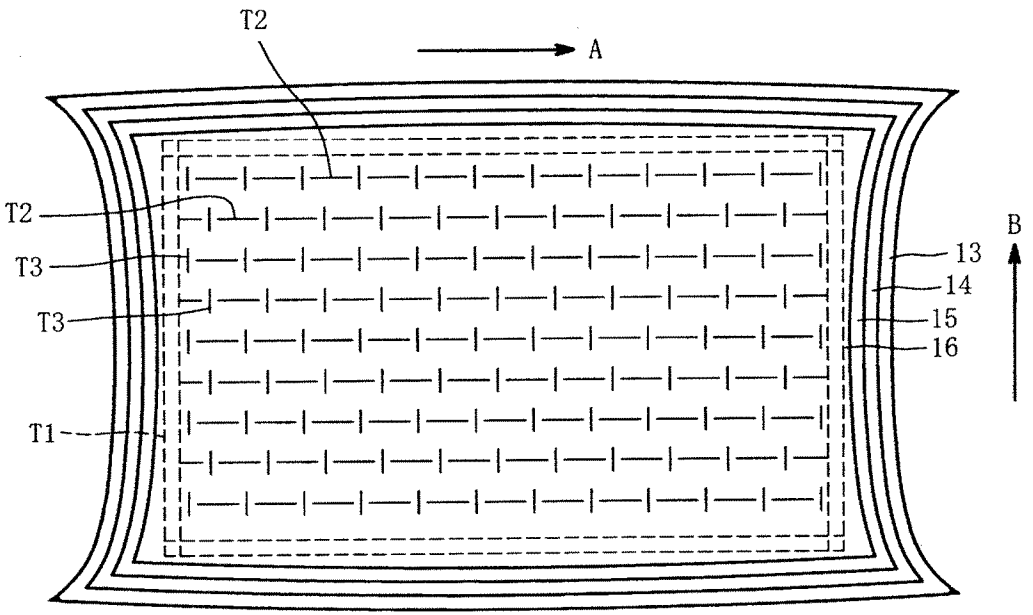

The following describes the configuration of the pier sound absorbing panel 10 with reference to FIG. 3 to FIG. 5. FIG. 3(*a*) is a front view of a pier sound absorbing panel, and FIG. 3(*b*) is a back view of the pier sound absorbing panel. Here, in this embodiment, the front side denotes the state of the pier sound absorbing panel 10 viewed from the cabin side while the back side (backside surface) denotes the opposite surface to the front side. FIG. 4(*a*) is a cross-sectional view taken along the cross-sectional line IVa-IVa illustrated in FIG. 3(*a*). FIG. 4(*b*) is a cross-sectional view taken along the cross-sectional line IVb-IVb illustrated in FIG. 3(*a*). FIG. 5(*a*) is an exploded view of the pier sound absorbing panel. FIG. 5(*b*) is a front view of an inner layer.

As illustrated in FIG. 5(*a*), the pier sound absorbing panel 10 is constituted mainly of an aluminum-made base plate 11, first to fourth glass cloths 13, 14, 15, and 16, and a fifth glass cloth 17. As illustrated in FIG. 4, the first to fourth glass cloths 13, 14, 15, and 16 are stacked on the base plate 11. The first to fourth glass cloths 13, 14, 15, and 16 and the base plate 11 are coated by the fifth glass cloth 17. The edge portion of the fifth glass cloth 17 is interfolded and attached to the backside surface of the base plate 11. Here, the pier sound absorbing panel 10 is installed while the fifth glass cloth 17 faces the cabin side (the base plate 11 faces the inner wall surface side of the railway vehicle 1).

The aluminum-made base plate 11 is the plate as the base of the pier sound absorbing panel 10, and has a thickness of about 0.5 mm. As illustrated in FIG. 3(*b*), the hole 19 hooked by the hook F (see FIG. 2(*b*)) is opened at the center. At both the right and left sides, rectangular hook-and-loop fasteners 18 are adhered. As an adhesive, for example, a polychloroprene adhesive can be used. Further, on the backside surface of the base plate 11, an aluminum-made reinforcing plate 12 (see FIG. 4) is secured along the outer periphery of the backside surface.

As just described, the pier sound absorbing panel 10 is installed on the inner wall surface by the hook-and-loop fastener 18. This facilitates attachment and removal of the pier sound absorbing panel 10. The securement of the reinforcing plate 12 reduces the wave occurring in the pier sound absorbing panel 10 when the hook-and-loop fastener 18 is secured to the backside surface of the base plate 11, thus allowing installing the pier sound absorbing panel 10 in a flat condition.

As illustrated in FIG. 4, the first to fourth glass cloths 13, 14, 15, and 16 constitute the inner layer enclosed between the base plate 11 and the fifth glass cloth 17. Each of the glass cloth 13 and a similar glass cloth is an identical glass cloth that has sound absorbency and heat resistance and is formed in a sheet shape by weaving a cloth from an elongated fiber-like glass. The thickness per glass cloth is about 0.8 mm.

In the first to fourth glass cloths 13, 14, 15, and 16, as illustrated in FIG. 5(*b*), the first glass cloth 13 is largest and the size decreases (is reduced) in the order corresponding to the second, third, and fourth glass cloths 14, 15, and 16. That is, the size becomes smaller as the glass cloth becomes further apart from the base plate 11. Accordingly, the side surface of the first to fourth glass cloths 13, 14, 15, and 16 is formed in a staircase pattern as illustrated in FIG. 4.

Further, as illustrated in FIG. 5(*b*), the first to fourth glass cloths 13, 14, 15, and 16 are coupled by metallic staples T1, T2, and T3. The metallic staples T1, T2, and T3 each include a center portion and a bent portion, which is bent from both end portions of the center portion. Here, FIG. 5(*b*) illustrates the center portions alone.

The staples T1 are formed in two rows in a rectangular shape at the outer periphery of the fourth glass cloth 16. The staples T2 are disposed such that the longitudinal directions of the center portions are oriented to an arrow A direction, a plurality of rows where the staples T2 are arranged at predetermined intervals along the arrow A direction are formed in an arrow B direction, and the center portions adjacent to one another in the arrow B direction are formed in a staggered arrangement. The staples T3 are formed between the staples T2 such that the longitudinal directions of the center portions are oriented to the arrow B direction, a plurality of rows where the staples T3 are arranged at predetermined intervals along the arrow B direction are formed in the arrow A direction, and the center portions adjacent to one another in the arrow A direction are formed in a staggered arrangement.

When the first to fourth glass cloths 13, 14, 15, and 16 are coupled together such that the staples T1, T2, and T3 are formed as just described, the first to fourth glass cloths 13, 14, 15, and 16 do not have uneven surfaces and can be flatly coupled together. Here, the first glass cloth 13 and the base plate 11 are secured to each other with an adhesive.

As illustrated in FIG. 4, the fifth glass cloth 17 encloses the first to fourth glass cloths 13, 14, 15, and 16 and the base plate 11. The fifth glass cloth 17 is a glass cloth similar to those of the first to fourth glass cloths 13, 14, 15, and 16, and has sound absorbency and heat resistance and is formed in a sheet shape by weaving a cloth from an elongated fiber-like glass. The thickness is about 0.8 mm.

However, unlike the first to fourth glass cloths 13, 14, 15, and 16, the fifth glass cloth 17 is exposed to the inside of the cabin. Accordingly, the glass cloth is preferred to be excellent in texture and appearance compared with the first to fourth glass cloths 13, 14, 15, and 16, that is, preferred to have a high density of the glass fibers and a pattern.

As illustrated in FIG. 4, in the fifth glass cloth 17, the portion covering the side portion of the first to fourth glass cloths 13, 14, 15, and 16 constituting the inner layer inclines to expand from the fourth glass cloth 16 toward the base plate 11 (form an acute angle with the base plate 11). This is because the side surface of the first to fourth glass cloths 13, 14, 15, and 16 is formed in a staircase pattern as described above. Accordingly, the thickness of the outer periphery of the pier sound absorbing panel 10 becomes thinner toward the outer side. Accordingly, as illustrated in FIG. 2(*a*), this portion can be easily inserted between the window frame W1 and the inner wall surface. Further, as illustrated in FIG. 4, the fifth glass cloth 17 encloses the reinforcing plate 12 and has an end portion extending to the inner side of the reinforcing plate 12, and is secured with an adhesive on the backside surface of the base plate 11. Here, the adhesive identical to the above-described adhesive can be used.

As just described, the pier sound absorbing panel 10 includes the five glass cloths of the first to fifth glass cloths 13 to 17 stacked on the aluminum-made base plate 11. This ensures a cushioning property. The vibrations of the first to fifth glass cloths 13 to 17 can, absorb the vibration inside the cabin. Further, the fifth glass cloth 17 is interfolded and attached to the backside surface of the base plate 11 with an adhesive. The first to fourth glass cloths 13, 14, 15, and 16 are fastened by the staples T1 to T3, which are non-combustible matters.

That is, the first glass cloth 13 and the base plate 11 are secured to each other with the adhesive. Melting of this adhesive is prevented by the five glass cloths of the first to fifth glass cloths 13 to 17. Melting of the adhesive securing the edge portion of the fifth glass cloth 17 on the backside surface of the base plate 11 is prevented by the five glass cloths of the first to fifth glass cloths 13 to 17 and the base plate 11. Accordingly, the pier sound absorbing panel 10 can satisfy the heat resistance and the melt-dripping resistance required for the inside of the cabin using the stacked five glass cloths of the first to fifth glass cloths 13 to 17.

Figure 6:
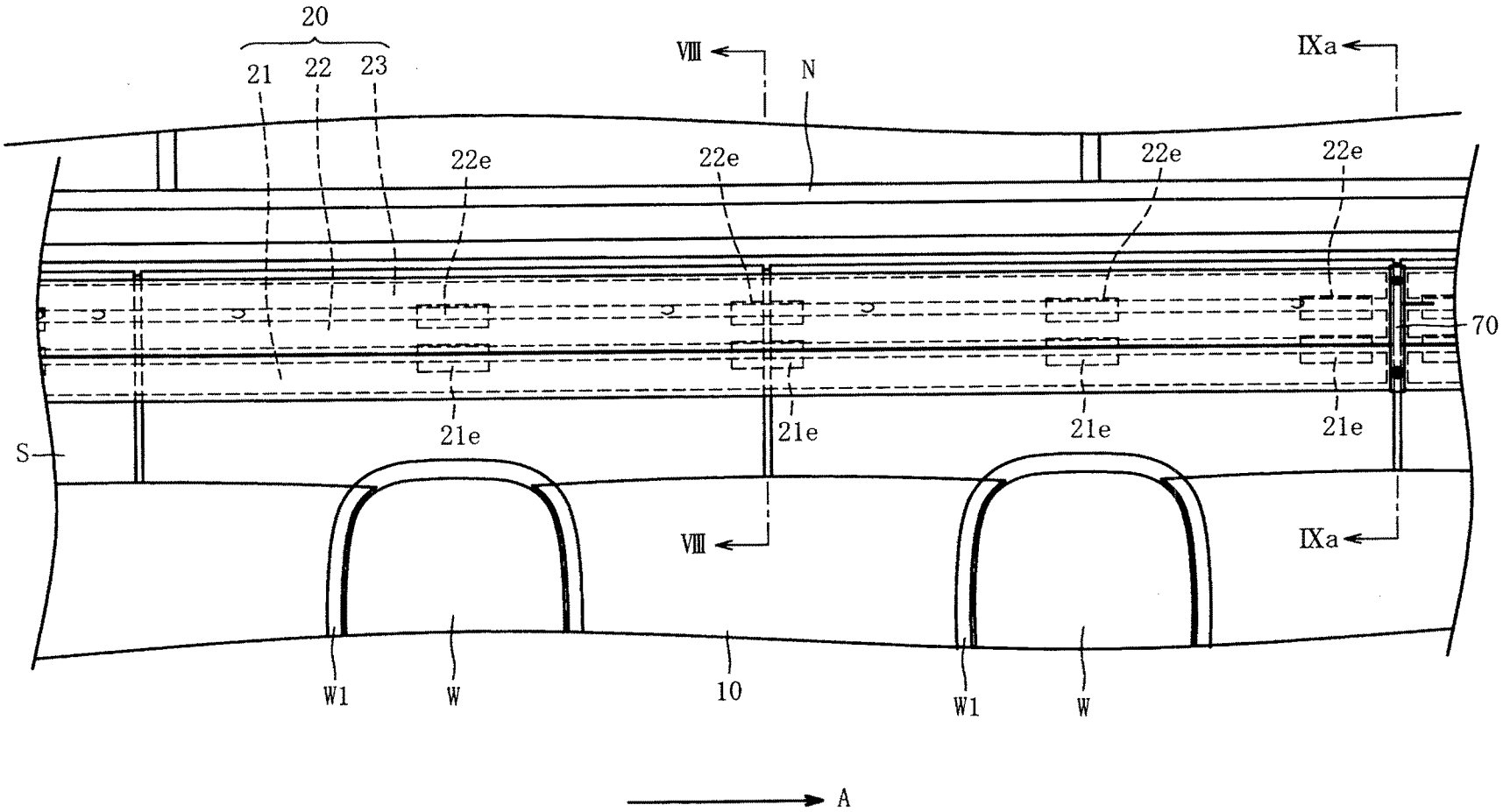
FIG. 6 is a front view of the vicinity of the portion at the upper side of the window viewed from the cabin side.
Figure 7A:
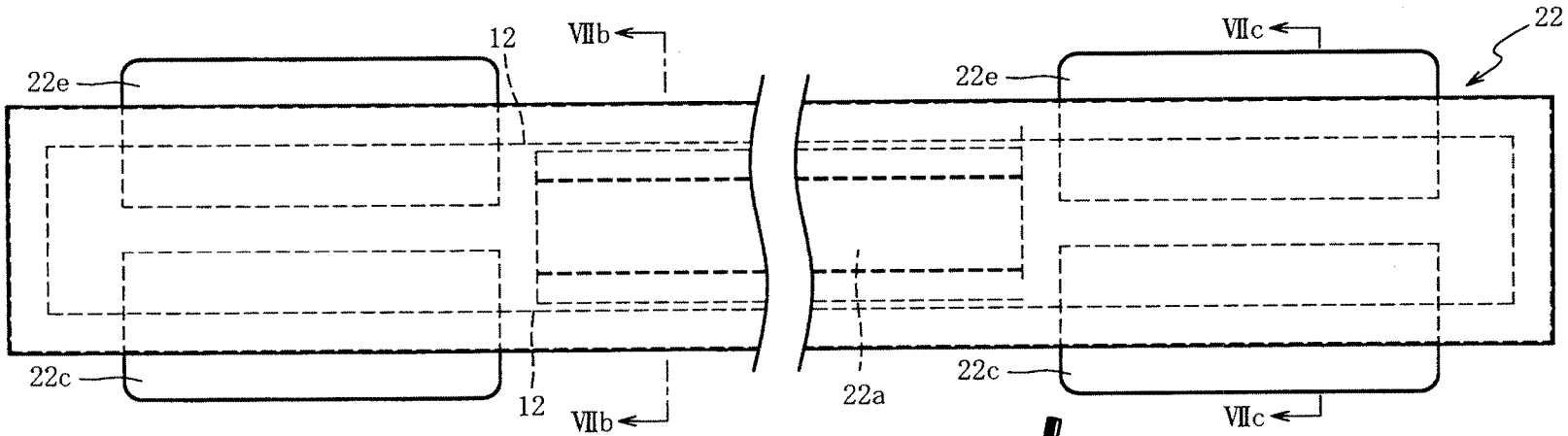
FIG. 7(*a*) is a front view of a middle sound absorbing panel, FIG. 7(*b*) is a cross-sectional view taken along the cross-sectional line VIIb-VIIb illustrated in FIG. 7(*a*), and FIG. 7(*c*) is a cross-sectional view taken along the cross-sectional line VIIc-VIIc illustrated in FIG. 7(*a*).
Figure 7C:
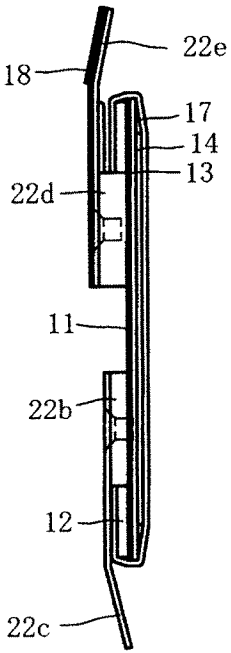
Figure 7B:
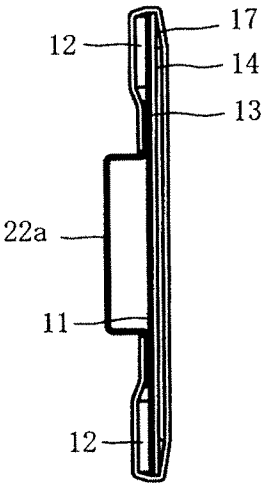
Figure 8:
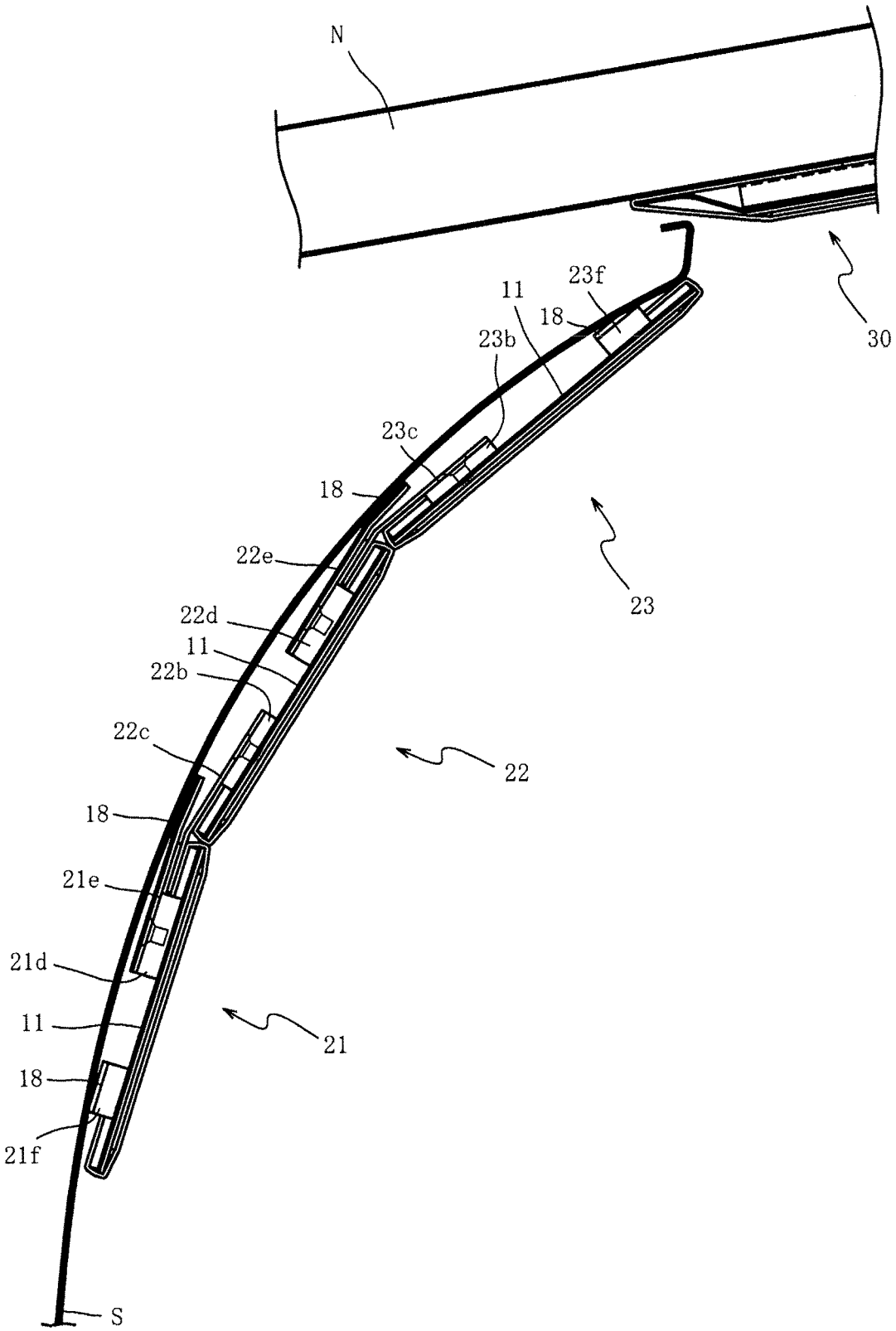
FIG. 8 is a cross-sectional view taken along the cross-sectional line VIII-VIII in FIG. 6.

The following describes the upper-side-wall sound absorbing panel 20 with reference to FIG. 6 to FIG. 8. FIG. 6 is a front view of the vicinity of the portion at the upper side of the window viewed from the cabin side. The upper-side-wall sound absorbing panel 20 is installed on the inner wall surface in an arc shape extending from the space P to the lower side of the baggage rack N. The upper-side-wall sound absorbing panel 20 is constituted of a lower sound absorbing panel 21, a middle sound absorbing panel 22, and an upper sound absorbing panel 23 in this order from the window W side (the lower side).

That is, the lower sound absorbing panel 21, the middle sound absorbing panel 22, and the upper sound absorbing panel 23 are formed in rectangular shapes having the longitudinal directions in the arrow A direction. The upper-side-wall sound absorbing panel 20 is constituted such that these three sound absorbing panels 21 to 23 are arranged in the up-down direction and coupled to one another by second coupling fittings 21*e* and 22*e*. The length of the upper-side-wall sound absorbing panel 20 in the arrow A direction varies depending on the position, and, for example, is set within a range from about 1 m to 2 m.

The following describes the configuration of the middle sound absorbing panel 22 in the lower sound absorbing panel 21, the middle sound absorbing panel 22, and the upper sound absorbing panel 23, which constitute the upper-side-wall sound absorbing panel 20, with reference to FIG. 7. FIG. 7(*a*) is a front view of the middle sound absorbing panel 22. FIG. 7(*b*) is a cross-sectional view taken along the cross-sectional line VIIb-VIIb illustrated in FIG. 7(*a*). FIG. 7(*c*) is a cross-sectional view taken along the cross-sectional line VIIc-VIIc illustrated in FIG. 7(*a*).

The basic configuration of the middle sound absorbing panel 22 is similar to the above-described pier sound absorbing panel 10. The pier sound absorbing panel 10 is installed on a flat inner wall surface. In contrast, the middle sound absorbing panel 22 (the upper-side-wall sound absorbing panel 20) is installed on the inner wall surface formed in an arc shape toward the ceiling surface of the railway vehicle 1. Accordingly, the middle sound absorbing panel 22 has the configuration different from that of the above-described pier sound absorbing panel 10. Here, the configuration different from that of the pier sound absorbing panel 10 is mainly described. Like reference numerals designate corresponding or identical elements throughout the configurations in common between the middle sound absorbing panel 22 and the pier sound absorbing panel 10, and therefore such elements will not be further elaborated here.

The above-described pier sound absorbing panel 10 includes the five glass cloths (the first to fifth glass cloths 13 to 17) stacked on the base plate 11. In contrast, the middle sound absorbing panel 22 includes three glass cloths (the first, second, and fifth glass cloths 13, 14, and 17) stacked on the base plate 11.

The pier sound absorbing panel 10 is arranged in the position close to the passenger, and thus might be frequently in contact with the passenger. Therefore, to improve the cushioning property, the five glass cloths are stacked. On the other hand, the installed position of the middle sound absorbing panel 22 (the upper-side-wall sound absorbing panel 20) is not the position frequently touched by the passenger. Therefore, the middle sound absorbing panel 22 (the upper-side-wall sound absorbing panel 20) includes the three stacked glass cloths (the first, second, and fifth glass cloths 13, 14, and 17). Here, even with the three glass cloths, the heat resistance and the melt-dripping resistance required for the railway vehicle 1 can be satisfied.

As the configuration that is not included in the pier sound absorbing panel 10, the middle sound absorbing panel 22 includes a support metal fitting 22*a*, a first strike plate 22*b*, a first coupling fitting 22*c*, a second strike plate 22*d*, and a second coupling fitting 22*e* that are secured to the backside surface of the base plate 11.

As illustrated in FIG. 7(*b*), the support metal fitting 22*a* is formed in a hat shape in cross-sectional view and projects from the backside surface of the base plate 11 in the middle sound absorbing panel 22 with respect to the outer periphery of the backside surface of the middle sound absorbing panel 22. When the middle sound absorbing panel 22 is installed on the inner wall surface in an arc shape, a space is formed between the base plate 11 and the inner wall surface in the center of the backside surface of the middle sound absorbing panel 22. If this portion is pressed, the middle sound absorbing panel 22 might be depressed toward the inner wall surface side. In contrast, since the support metal fitting 22*a* is included, the supporting member 22*a* functions as a support if this space is pressed. This inhibits the middle sound absorbing panel 22 from being depressed toward the inner wall surface side.

The first strike plate 22*b* and the first coupling fitting 22*c* are metal fittings for coupling to the lower sound absorbing panel 21 (the second coupling fitting 21*e* extending from the lower sound absorbing panel 21) (see FIG. 6) coupled at the lower side of the middle sound absorbing panel 22.

The first strike plate 22*b* is an aluminum-made metal piece that projects from the backside surface of the base plate 11 in the middle sound absorbing panel 22 at the lower sound absorbing panel 21 side (the lower side in FIG. 7(*b*)). The first coupling fitting 22*c* is screwed to the first strike plate 22*b* at one end side. The other end side is a stainless-steel metallic material that extends to the lower sound absorbing panel 21 side (the lower side in FIG. 7(*b*)) and is slightly bent from the position beyond the first glass cloth 17 toward the base plate 11 side.

The second strike plate 22*d* and the second coupling fitting 22*e* are metal fittings for coupling to the upper sound absorbing panel 23 (a coupling fitting 23*c* extending from the upper sound absorbing panel 23) (see FIG. 8) coupled at the upper side of the middle sound absorbing panel 22.

The second strike plate 22*d* is an aluminum-made metal piece that projects from the backside surface of the base plate 11 in the middle sound absorbing panel 22 at the upper sound absorbing panel 23 side (the upper side in FIG. 7(*b*)). The second coupling fitting 22*e* is screwed to the second strike plate 22*d* at one end side. The other end side is a stainless-steel metallic material that extends to the upper sound absorbing panel 23 side (the upper side in FIG. 7(*b*)) and is slightly bent from the position beyond the first glass cloth 17 toward the base plate 11 side. Here, at the distal end of the second coupling fitting 22*e*, the hook-and-loop fastener 18 is secured with an adhesive.

The following describes the case where the upper-side-wall sound absorbing panel 20 (the lower sound absorbing panel 21, the middle sound absorbing panel 22, and the upper sound absorbing panel 23) is installed on the inner wall surface of the railway vehicle 1 with reference to FIG. 8. FIG. 8 is a cross-sectional view taken along the cross-sectional line VIII-VIII in FIG. 6.

As the configuration corresponding to the second strike plate 22*d* and the second coupling fitting 22*e*, which are disposed at the above-described middle sound absorbing panel 22, the lower sound absorbing panel 21 includes a second strike plate 21*d* and a second coupling fitting 21*e* in the end portion of the lower sound absorbing panel 21 at the middle sound absorbing panel 22 side. To the second coupling fitting 21*e*, the hook-and-loop fastener 18 is secured with an adhesive. Further, the lower sound absorbing panel 21 includes a hook-and-loop-fastener strike plate 21*f* projecting in one end at the opposite side to the second strike plate 21*d*. To the end surface of the hook-and-loop-fastener strike plate 21*f*, the hook-and-loop fastener 18 is secured via an adhesive. Here, while not illustrated, the lower sound absorbing panel 21 also includes the configuration corresponding to the support metal fitting 22*a* (see FIG. 7) disposed at the middle sound absorbing panel 22.

As the configuration corresponding to the first strike plate 22*b* and the first coupling fitting 22*c*, which are disposed at the middle sound absorbing panel 22, the upper sound absorbing panel 23 includes a first strike plate 23*b* and the first coupling fitting 23*c* in the end portion of the upper sound absorbing panel 23 at the middle sound absorbing panel 22 side. The upper sound absorbing panel 23 includes a hook-and-loop-fastener strike plate 23*f* projecting in one end at the opposite side to the first strike plate 23*b*. To the end surface of the hook-and-loop-fastener strike plate 23*f*, the hook-and-loop fastener 18 is secured via an adhesive. Here, while not illustrated, the upper sound absorbing panel 23 also includes the configuration corresponding to the support metal fitting 22*a* (see FIG. 7) disposed at the middle sound absorbing panel 22.

The lower sound absorbing panel 21, the middle sound absorbing panel 22, and the upper sound absorbing panel 23 are coupled together as follows. That is, the first coupling fitting 22*c*, which extends from the middle sound absorbing panel 22 toward the lower sound absorbing panel 21 is inserted into the space formed between the second coupling fitting 21*e*, which extends from the lower sound absorbing panel 21 toward the middle sound absorbing panel 22, and the backside surface of the lower sound absorbing panel 21. The facing surfaces of the first coupling fitting 22*c* and the second coupling fitting 21*e* are secured to each other with an adhesive. Here, the adhesive similar to that described above is applicable.

The first coupling fitting 23*c*, which extends from the upper sound absorbing panel 23 toward the middle sound absorbing panel 22, is inserted into the space formed between the second coupling fitting 22*e*, which extends from the middle sound absorbing panel 22 toward the upper sound absorbing panel 23, and the backside surface of the middle sound absorbing panel 22. The facing surfaces of the first coupling fitting 23*c* and the second coupling fitting 22*e* are secured together with an adhesive.

Thus, the lower sound absorbing panel 21, the middle sound absorbing panel 22, and the upper sound absorbing panel 23 are coupled together. Then, the upper-side-wall sound absorbing panel 20 (the lower sound absorbing panel 21, the middle sound absorbing panel 22, and the upper sound absorbing panel 23) is secured to the inner wall surface of the railway vehicle 1 by the hook-and-loop fastener 18 secured to the hook-and-loop-fastener strike plate 21*f* of the lower sound absorbing panel 21, the hook-and-loop fastener 18 secured at the distal end of the second coupling fitting 21*e* of the lower sound absorbing panel 21, the hook-and-loop fastener 18 secured at the distal end of the second coupling fitting 22*e* of the middle sound absorbing panel 22, the hook-and-loop fastener 18 secured to the hook-and-loop-fastener strike plate 23*f* of the upper sound absorbing panel 23.

Here, the lower sound absorbing panel 21 and the upper sound absorbing panel 23 each include the configuration corresponding to the supporting member 22*a* (see FIG. 7) disposed at the middle sound absorbing panel 22. Accordingly, if the spaces between the respective sound absorbing panels 21 to 23 and the inner wall surface are pressed, the support metal fitting 22*a* functions as a support so as to inhibit the respective sound absorbing panels 21 to 23 from being depressed toward the inner wall surface side.

Figure 9A:
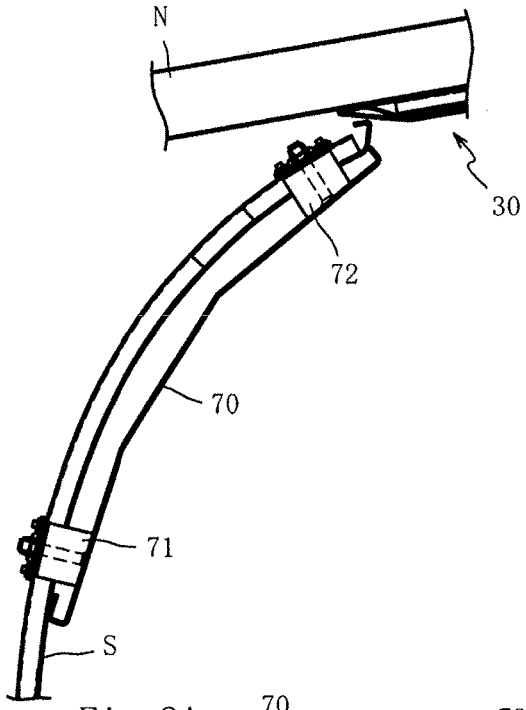
FIG. 9(*a*) is a cross-sectional view taken along the cross-sectional line IXa-IXa illustrated in FIG. 6, FIG. 9(*b*) is a front view of a presser plate, and FIG. 9(*c*) is a side view of the presser plate.
Figure 9B:
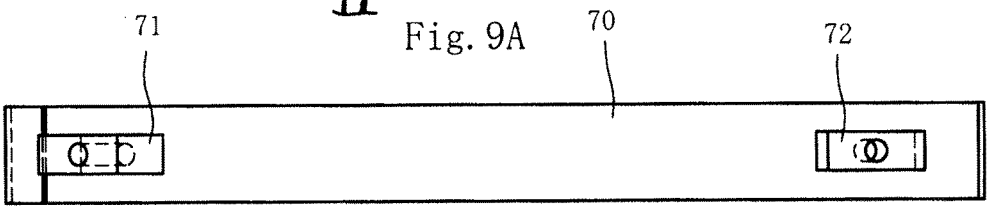
Figure 9C:
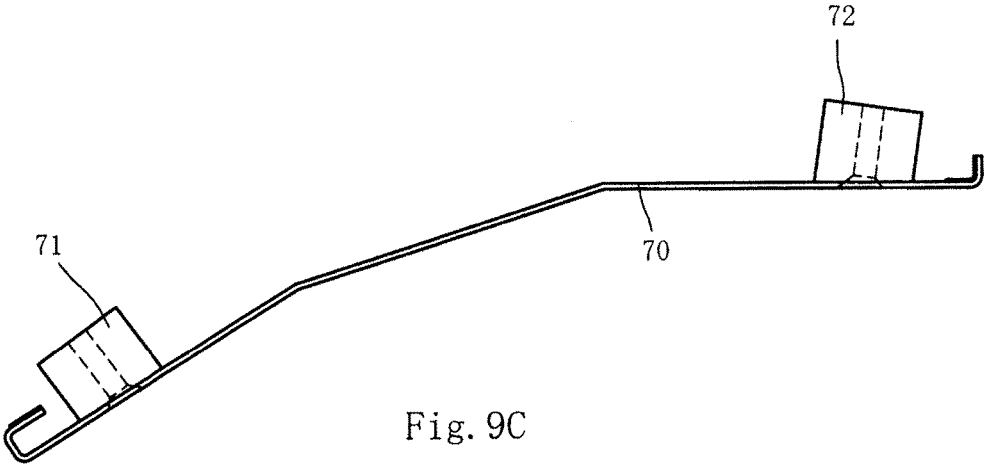

As illustrated in FIG. 6, on the inner wall surface of the railway vehicle 1, a presser plate 70 is disposed in the portion where the end portion of the upper-side-wall sound absorbing panel 20 in the arrow A direction is located. Here, the presser plate 70 will be described with reference to FIG. 9. FIG. 9(*a*) is a cross-sectional view taken along the cross-sectional line IXa-IXa illustrated in FIG. 6. FIG. 9(*b*) is a front view of the presser plate 70. FIG. 9(*b*) is a side view of the presser plate 70.

The presser plate 70 sandwiches and presses the end portion of the upper-side-wall sound absorbing panel 20 in the arrow A direction between the presser plate 70 and the inner wall surface of the railway vehicle 1. The presser plate 70 is formed in a strip shape with a predetermined width, and is formed in the shape approximately along the inner wall surface on which the upper-side-wall sound absorbing panel 20 is installed in the railway vehicle 1. Here, the presser plate 70 has a lower end bent in a U shape and an upper end bent in an L shape.

At the lower end side of the presser plate 70, a first base 71 is disposed to protrude. At the upper end side, a second base 72 is disposed to protrude. In the first base 71 and the second base 72, thread grooves are formed. On the inner wall surface S of the railway vehicle 1, insertion slots into which the first base 71 and the second base 72 are inserted are opened. On the outer surface of the inner wall, nuts are secured.

Accordingly, these first base 71 and second base 72 are inserted into the inner wall surface and fastened with countersunk screws. This allows the inner wall surface S of the railway vehicle 1 and the inner surface of the presser plate 70 to press the end portion of the upper-side-wall sound absorbing panel 20 in the arrow A direction, thus preventing the upper-side-wall sound absorbing panel 20 from being dropped off.

As just described, the upper-side-wall sound absorbing panel 20 is installed on the inner wall surface of the railway vehicle 1 after the lower sound absorbing panel 21, the middle sound absorbing panel 22, and the upper sound absorbing panel 23 are coupled together. This allows efficiently installing the upper-side-wall sound absorbing panel 20 if the inner wall surface is curved.

Figure 10A:
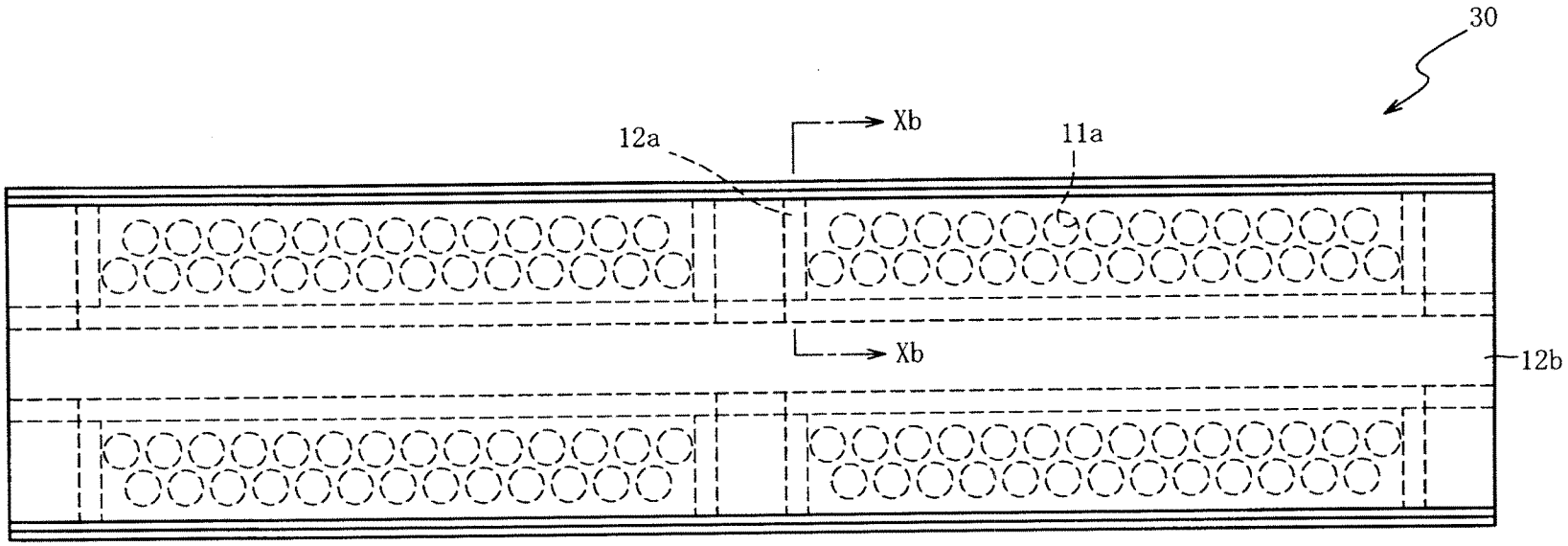
FIG. 10(*a*) is a front view of a baggage-rack lower sound absorbing panel, and FIG. 10(*b*) is a cross-sectional view taken along the cross-sectional line Xb-Xb illustrated in FIG. 10(*a*).
Figure 10B:
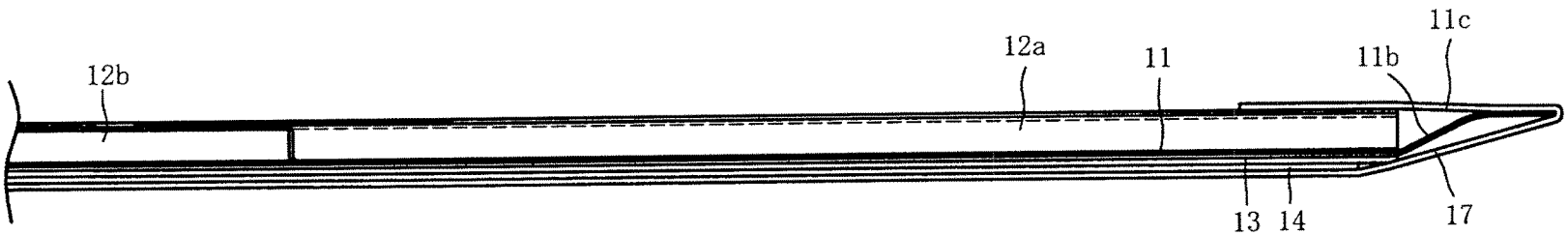
Figure 11:
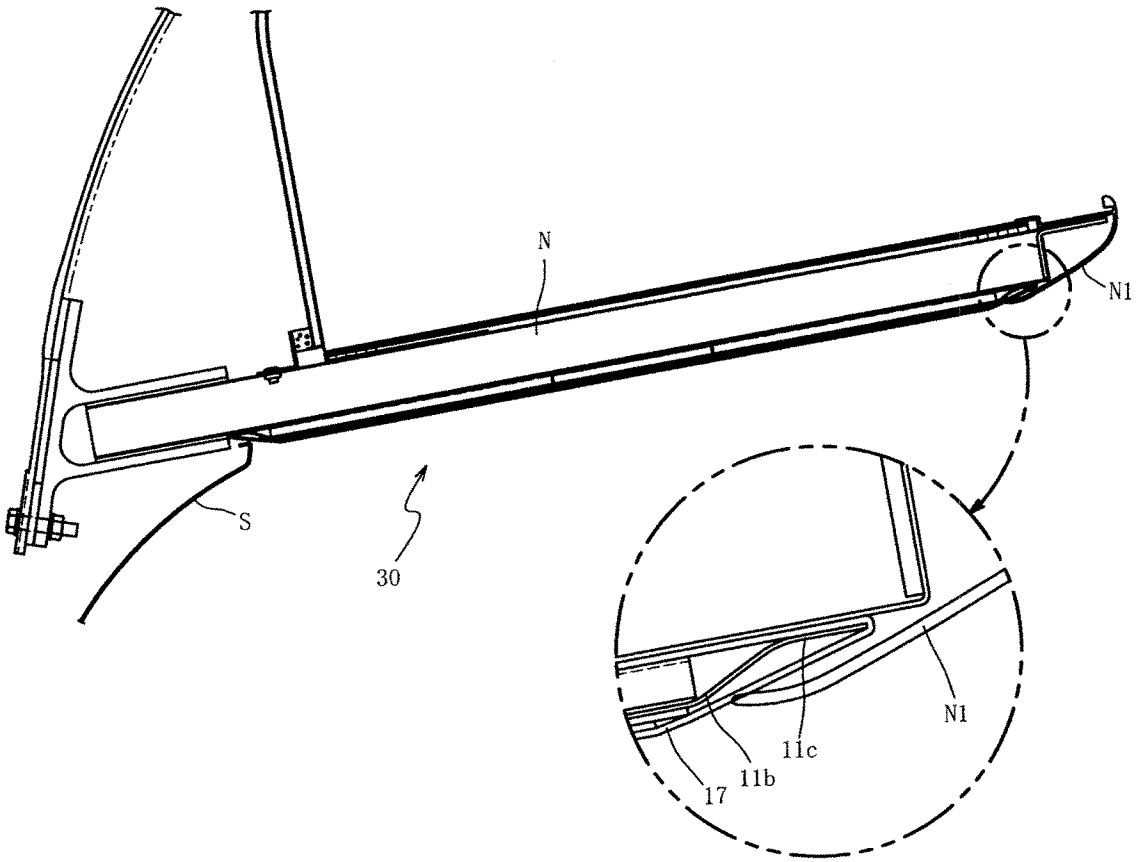
FIG. 11 is a cross-sectional view illustrating a state where the baggage-rack lower sound absorbing panel is installed on a baggage rack.

The following describes the baggage-rack lower sound absorbing panel 30 with reference to FIG. 10 and FIG. 11. FIG. 10(*a*) is a front view of the baggage-rack lower sound absorbing panel 30. FIG. 10(*b*) is a cross-sectional view taken along the cross-sectional line Xb-Xb illustrated in FIG. 10(*a*). FIG. 11 is a cross-sectional view illustrating a state where the baggage-rack lower sound absorbing panel 30 is installed on the baggage rack N.

The baggage-rack lower sound absorbing panel 30 is the sound absorbing panel (see FIG. 11) installed over the entire surface of the inferior surface of the baggage rack N. The basic configuration of the baggage-rack lower sound absorbing panel 30 is similar to that of the above-described pier sound absorbing panel 10. Accordingly, the configuration different from that of the pier sound absorbing panel 10 is mainly described below. Like reference numerals designate corresponding or identical elements throughout the configurations in common between the baggage-rack lower sound absorbing panel 30 and the pier sound absorbing panel 10, and therefore such elements will not be further elaborated here.

While the base plate 11 of the pier sound absorbing panel 10 is formed in a flat plate shape (see FIG. 5(*a*)), the baggage-rack lower sound absorbing panel 30 has a different shape of the outer peripheral portion of the base plate 11. That is, the outer peripheral portion of the base plate 11 in the baggage-rack lower sound absorbing panel 30 includes, as illustrated in FIG. 10(*b*), an inclined portion 11*b* and an edge portion 11*c*. The inclined portion 11*b* inclines to outwardly expand to the opposite side to the first glass cloth 13. The edge portion 11*c* horizontally extends from the end portion of the inclined portion 11*b*. The fifth glass cloth 17 covers the inclined portion 11*b* and the edge portion 11*c*, and is adhesively secured to the backside surface of the base plate 11.

That is, the outer peripheral portion of the baggage-rack lower sound absorbing panel 30 is constituted of the inclined portion 11*b*, the edge portion 11*c*, and the fifth glass cloth 17, which covers these portions, and is set to be thinner than the outer peripheral portion of the pier sound absorbing panel 10. Accordingly, as illustrated in FIG. 11, the distal end of the baggage-rack lower sound absorbing panel 30 with respect to the cabin side can be installed by being inserted between a front bar N1, which is installed at the front end of the baggage rack N, and the inferior surface of the baggage rack N. The trailing end of the baggage-rack lower sound absorbing panel 30 with respect to the cabin side can be installed by being inserted between the inner wall (inner wall surface S) of the railway vehicle 1 and the inferior surface of the baggage rack N. This prevents the baggage-rack lower sound absorbing panel 30 from being dropped off from the baggage rack N.

Since the base plate 11 of the baggage-rack lower sound absorbing panel 30 includes the inclined portion 11*b* and the edge portion 11*c* in the outer peripheral portion, the space surrounded by the inclined portion 11*b* is formed on the backside surface of the base plate 11. Accordingly, this space can absorb sound noise coming via through-holes 11*a*, which are opened at the base plate 11. On the backside surface of the base plate 11, as illustrated in FIG. 10, reinforcing plates 12*a* and 12*b* are secured. This prevents occurrence of a wave in the baggage-rack lower sound absorbing panel 30, depression of the baggage-rack lower sound absorbing panel 30 toward the baggage rack N side if the baggage-rack lower sound absorbing panel 30 is pressed toward the baggage rack N, and similar trouble.

Here, similarly to the upper-side-wall sound absorbing panel 20, the baggage-rack lower sound absorbing panel 30 includes three glass cloths (the first, second, and fifth glass cloths 13, 14, and 17) stacked on the base plate 11. Since the installed position of the baggage-rack lower sound absorbing panel 30 is not the position frequently touched by the passenger, the required cushioning property is low. Therefore, three glass cloths are stacked. Here, even three glass cloths can satisfy the heat resistance and the melt-dripping resistance required for the inside of the railway vehicle 1.

As described above, the present invention has been described based on the above-mentioned embodiments. It will be appreciated that the present invention will not be limited to the embodiments described above, but various modifications are possible without departing from the technical scope of the present invention.

In the above-described embodiment, the description is mainly given of the pier sound absorbing panel 10, the upper-side-wall sound absorbing panel 20, and the baggage-rack lower sound absorbing panel 30. The baggage-rack upper sound absorbing panel 40, the side-ceiling sound absorbing panel 50, the end-portion sound absorbing panel 60, and the sound absorbing panel to be installed on the ceiling surface of the gangway each have the basic configuration identical to those of the pier sound absorbing panel 10, the upper-side-wall sound absorbing panel 20, and the baggage-rack lower sound absorbing panel 30.

In the above-described embodiment, the description is given of the pier sound absorbing panel 10 in the case where the first to fourth glass cloths 13 to 16 are coupled by the staples T1 to T3 while the first glass cloth 13 and the base plate 11 are secured with the adhesive. However, in the first to fourth glass cloths 13 to 16, the fourth glass cloth 16, the third glass cloth 15, the second glass cloth 14, the first glass cloth 13, and the base plate 11 may be secured to one another with the adhesives. Also in this case, the heat resistance and the melt-dripping resistance required for the inside of the railway vehicle 1 can be satisfied. That is, it is only necessary to couple at least two or more glass cloths to one another with a non-combustible material.

In the above-described embodiment, the description is given of the case where the five glass cloths are stacked in the pier sound absorbing panel 10 and the three glass cloths are stacked in the upper-side-wall sound absorbing panel 20 and the baggage-rack lower sound absorbing panel 30. This should not be construed in a limiting sense. It is only necessary to stack at least two or more glass cloths. However, taking into consideration the limitation on the thickness, it is preferred to stack five or fewer glass cloths.

In the above-described embodiment, the description is given of the case where the base plate 11 and the first glass cloth 13 are secured with the adhesive while the fifth glass cloth 17 is secured with the adhesive on the backside surface of the base plate 11. The method for securing these members is not limited to the adhesive, and it is only necessary to secure both the members. For example, both the members may be secured with an adhesive double coated tape. This is because these portions no longer affect the heat resistance and the melt-dripping resistance required for the inside of the railway vehicle 1.

In the above-described embodiment, the description is given of the case where the first to fourth glass cloths 13 to 16 are coupled by the metallic staples T1 to T3. The member for coupling these glass cloths is not limited to the staples T1 to T3, and it is only necessary to use a non-combustible coupling tool.

In the above-described embodiment, the description is given of the case where the pier sound absorbing panel 10 installed between the window W and the window W is integrally constituted. The pier sound absorbing panel 10 may be separately constituted. The count and the position of the through-hole 11*a* opened at the base plate 11 and the count and the position of the reinforcing plate 12 are not limited to those in the above-described embodiment.

The invention claimed is:

1. A sound absorbing panel installed on an inner wall surface of a railway vehicle, comprising:

a metallic base plate having a first surface and an opposite second surface;

an inner layer secured to the first surface of the base plate, the inner layer being constituted such that one glass cloth or at least two or more glass cloths are stacked; and a coating layer that is a glass cloth coating the inner layer from an opposite side to the base plate, the coating layer having an edge portion secured to the second surface of the base plate.

2. The sound absorbing panel according to claim 1, further comprising:

a hook-and-loop fastener secured to the second surface of the base plate;

a reinforcing plate secured to the second surface of the base plate while avoiding the hook-and-loop fastener; and a through hole opened at the base plate.

3. The sound absorbing panel according to claim 1, wherein the base plate and the inner layer are secured to one another with an adhesive, or the base plate and the edge portion of the coating layer are secured to one another with an adhesive.

4. The sound absorbing panel according to claim 1, wherein the coating layer has a portion covering a side portion of the inner layer, the covering portion inclining to form an acute angle with the base plate.

5. The sound absorbing panel according to claim 1, further comprising:

a supporting member secured at an inner side of an outer peripheral portion of the base plate on the second surface of the base plate, the supporting member projecting to an opposite side to the inner layer.

6. The sound absorbing panel according to claim 1, further comprising:

a coupling member secured to the second surface of the base plate, the coupling member laterally projecting with respect to the outer peripheral portion of the base plate coupled to another sound absorbing panel.

7. The sound absorbing panel according to claim 1, wherein the inner layer is constituted such that at least two or more glass cloths are stacked, at least two or more glass cloths from an opposite side of the base plate in the inner layer are coupled together with a staples, the staple including a center portion and a bent portion, the bent portion being bent from both end portions of the center portion, and the staples include:

a first-direction row group where: longitudinal directions of the center portions of the staples are oriented to a first direction; a plurality of rows where the staples are arranged at predetermined intervals along the first direction are formed in a second direction intersecting with the first direction; and the center portions adjacent to one another in the second direction are formed in a staggered arrangement; and a second-direction row group where: the staples are formed between the predetermined intervals; longitudinal directions of the center portions of the staples are oriented to the second direction; a plurality of rows where the staples are arranged at predetermined intervals along the second direction are formed in the first direction; and the center portions adjacent to one another in the first direction are formed in a staggered arrangement.

8. A railway vehicle, comprising:

a plurality of windows disposed at predetermined intervals from one another on an inner wall surface inside a cabin along a longitudinal direction of the cabin;

a baggage rack that projects from the inner wall surface at an upper side of the window to the inside of the cabin;

a gangway that couples a vehicle and a vehicle together; and the sound absorbing panel according to claim 1, wherein the sound absorbing panel is installed on at least one or more of: the inner wall surface between the windows adjacent to each other; the inner wall surface between the window and the baggage rack; an inferior surface of the baggage rack; a top surface of the baggage rack; the inner wall surface located at an upper side of the baggage rack; and an inner wall surface of the gangway.

9. The railway vehicle according to claim 8, further comprising:

a window trim that surrounds a peripheral area of the window, wherein the sound absorbing panel has an end portion sandwiched between the window trim and the inner wall surface.

10. The railway vehicle according to claim 8, further comprising:

a front bar installed on a distal end portion of the baggage rack, wherein the sound absorbing panel installed on the inferior surface of the baggage rack is sandwiched between the inferior surface of the baggage rack and the front bar.

11. The railway vehicle according to claim 8, further comprising:

a hole opened at the base plate of the sound absorbing panel; and a hook that projects from the inner wall surface to the cabin side to be hooked on the hole.

12. The railway vehicle according to claim 8, further comprising:

a first base that projects from the inner wall surface to the inside of the cabin;

a second base that projects from the inner wall surface to the inside of the cabin at a predetermined interval from the first base; and a plate-shaped presser plate bridged across a projecting end portion of the first base and a projecting end portion of the second base, the presser plate having a predetermined width, wherein end portions of the adjacent sound absorbing panels are sandwiched between the inner wall surface and the presser plate.

* * * * *